US008789767B2

(12) United States Patent
Serwacki

(10) Patent No.: US 8,789,767 B2
(45) Date of Patent: Jul. 29, 2014

(54) INDOOR WATER FIXTURE

(76) Inventor: Scott Serwacki, Picayune, MS (US)

( * ) Notice: Subject to any disclaimer, the term of this patent is extended or adjusted under 35 U.S.C. 154(b) by 199 days.

(21) Appl. No.: 12/876,345

(22) Filed: Sep. 7, 2010

(65) Prior Publication Data

US 2012/0056007 A1 Mar. 8, 2012

(51) Int. Cl.
*B05B 17/08* (2006.01)

(52) U.S. Cl.
USPC ..... 239/17; 239/16

(58) Field of Classification Search
USPC ..... 239/16, 17, 20, 12
See application file for complete search history.

(56) References Cited

U.S. PATENT DOCUMENTS 3,901,439 A * 8/1975 Willis ..... 239/12
4,836,142 A * 6/1989 Duback ..... 119/255
6,149,991 A * 11/2000 Okuda ..... 428/13
6,405,937 B1 * 6/2002 Stukenberg ..... 239/12
6,527,257 B1 * 3/2003 Schuld ..... 261/29
6,779,739 B2 * 8/2004 Mulvaney ..... 239/17
8,292,195 B2 * 10/2012 Freeman ..... 239/20

* cited by examiner

*Primary Examiner* — Davis Hwu
(74) *Attorney, Agent, or Firm* — Law Office of Jerry D. Haynes

(57) ABSTRACT

An indoor water fixture comprising a basin to hold a pool of water, a pair of back walls rising vertically from a back portion of the basin, where the pair of back walls fit against a corner of a room, a plurality of falls arranged against the pair of back walls to release water, a plurality of reservoirs positioned beneath the plurality of falls, where the plurality of reservoirs catch the water, a plurality of shelves positioned beneath the plurality of reservoirs to enable the water to fall into the pool, and a water pump built within the basin wherein the water pump circulates the water from the basin, behind the pair of back walls and into the falls.

5 Claims, 2 Drawing Sheets

INDOOR WATER FIXTURE

BACKGROUND OF THE INVENTION

1. Field of the Invention

The present invention relates to a decorative novelty apparatus to provide an indoor water fixture that fits into a corner of a room.

2. Description of Related Art

Fountains, water fixture and waterfalls are structures commonly known to add aesthetic appeal and beauty in any yard, city square or front building entrance. These structures are typically outdoors or possibly in the lobby of a large office building or airport, because the structures are bulky, heavy and obtrusive. Usually, the structures are immobile and are usually built in the location where they are going to remain.

Some manufacturers offer small desktop or shelf waterfalls for decorative pieces in a house or office. The small waterfalls may be replicas of the larger, grander scale water structures typically seen outdoors. Other small waterfalls may be window pieces to offer the illusion of rain against a glass. Many times these pieces are portable and may be small enough to be carried from one location to another. Options for individuals who want a water structure within their house that is of substantial size without the structure being large, bulky or general esthetically displeasing are limited.

It would be beneficial in the art to provide an indoor water structure that is not bulky or obtrusive and possesses a pleasing appearance. It would also be desirable to have a water structure which offers a soothing and relaxing sound to be enjoyed by individuals inside a home or office.

SUMMARY OF THE INVENTION

The object of the present invention is to disclose an indoor water fixture comprising a basin to hold a pool of water, a pair of back walls rising vertically from a back portion of the basin, where the pair of back walls fit against a corner of a room, a plurality of falls arranged against the pair of back walls to release water, a plurality of reservoirs positioned beneath the plurality of falls, where the plurality of reservoirs catch the water, a plurality of shelves positioned beneath the plurality of reservoirs to enable the water to fall into the pool, and a water pump built within the basin wherein the water pump circulates the water from the basin, behind the pair of back walls and into the falls.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DRAWINGS

The present invention relates to a decorative novelty apparatus to provide an indoor water fixture that fits into a corner of a room. The indoor water fixture offers consumers a decorative, floor standing waterfall that offers an optimal space saving configuration. A person may enjoy the relaxing, and soothing sounds of the water as it flows down the walls of the structure. The indoor water fixture comprises an electric motor with multiple valves to direct and control the flow of the cascading water. The unique design of the indoor water fixture allows users to enjoy the peaceful and soothing qualities of a waterfall without the obtrusive and bulky inconveniences of a typical water structure.

Figure 1:
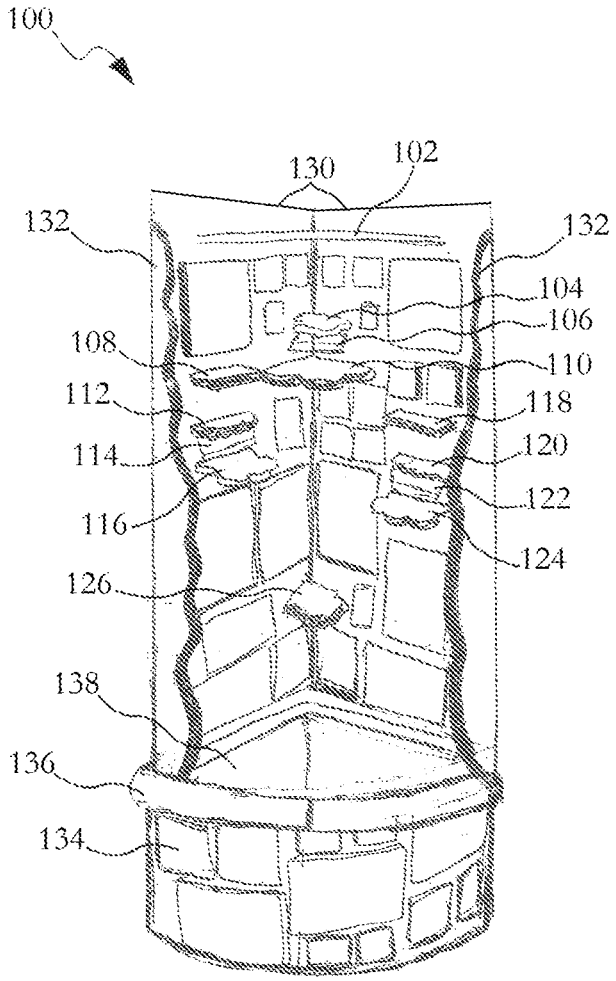
FIG. 1 depicts a perspective view of an indoor waterfall in accordance with an exemplary embodiment of the present invention.

Turning now descriptively to the drawings, referring to FIG. 1, a perspective view of an indoor fixture (100) is shown in accordance with an exemplary embodiment of the present invention. The indoor water fixture (100) may be a waterfall or water apparatus assembled inside a home, apartment, office building or office. The indoor water fixture (100) may comprise a plurality of outlets (104, 108 and 118), a plurality of falls (112, 120 and 126), a plurality of reservoirs (106, 114 and 122) and a plurality of shelves (110, 116 and 124). At an upper portion of the indoor water fixture (100) may be an upper shelf (102) attached between a pair of back walls (130). The upper shelf (102) may serve as a top housing or upper containment wall. The pair of back walls (130) gives the indoor water fixture (100) structural integrity and a base to put the elemental features.

Below the upper shelf (102), may be an upper fall (104). Water is pumped from behind the pair of walls (130) and travels over the upper fall (104). From the upper fall (104), the water travels into a reservoir (106). The reservoir (106) enables the water to pool before it flows over a shelf (110). From the shelf (110), the water falls to a lower fall (126) before finally landing into a pool (138). Alternatively, three holes may be drilled above the upper fall (104) to enable water to escape and flow over the reservoir (106), the shelf (110) and into the pool (138). A second waterfall may flow from another outlet (108) from behind the pair of walls (130). The water flows from the outlet (108) to a second fall (112) and into a second reservoir (114). After the water pools in the second reservoir (114) it will spill and flow over a second shelf (116). Finally, the water from the second waterfall will fall into the pool (138). Still a third waterfall may flow from the indoor water fixture (100). The water from the third waterfall flows from an outlet (118), over a third fall (120), into a third reservoir (122), over a third shelf (124) and into the pool (138). Filling the reservoirs (106, 114 and 122) is imperative for the water flow of the indoor water fixture to give the structure a more realistic appearance.

The various outlets, falls, reservoirs and shelves may be arranged decoratively along the pair of walls (130) to create a beautiful and ornamental design. The pair of back walls (130) may have decorative rocks, tiles, bricks or blocks covering them for greater aesthetic appeal. To ensure that none of the water from any of the waterfalls overflows or splashes out of the indoor water fixture (100) are a pair of splash guards (132) attached to the peripheral portions of the pair of back walls (130). At the lower end of the pair of back walls (130) and the pair of splash guards (132) is a basin (134). The basin (134)

houses the pool (138) and catches the water as it flows from the various waterfalls. Along upper portion of the basing (134), stretching between the pair splash guards (132), may be a rim (136). The rim (136) may serve as a finished edge or lip for the basin (134).

The basin (134) may have a triangular or pie piece shape. The back corner of the basin (134) and the location where the pair of back walls (130) meet may be a segment where the indoor water fixture (100) rests into a corner of a room. Additional decorative elements may be added to the basin (134). For example, within the basin (134) may be a plurality of submersible waterproof lights provide an added decorative element in the pool (138). Also, an audio device may be housed behind or within the walls of the basin (134). Finally a shelf or shelving unit may extend from the rim (136) to hold, store or display personal items.

Behind the indoor water fixture (100) may be a water pump to circulate the water for the waterfalls. A motor may be housed within or behind the basin (134). A waterproof electrical plug is attached to the motor to activate the water pump. The water may be sucked from the pool (138), into a set of tubes which are controlled by a set of valves, all of which are configured behind the pair of back walls (130). The motor pushes the water against gravity to rise within the tubes and up the backside of the pair of back walls (130). Three sets of tubes and valves may feed water to the fall (104), the outlet (108) and the outlet (118). The water may be continuously recycled so that as the motor pumps water through the sets of tubes and valves, the waterfalls drop the water back down to refill the pool (138). The motor may have an activation switch to turn the motor on and off for use. When nobody is in the room the indoor water fixture (100) may rest idle until a person returns and desires the structure to be turned on.

Figure 2:
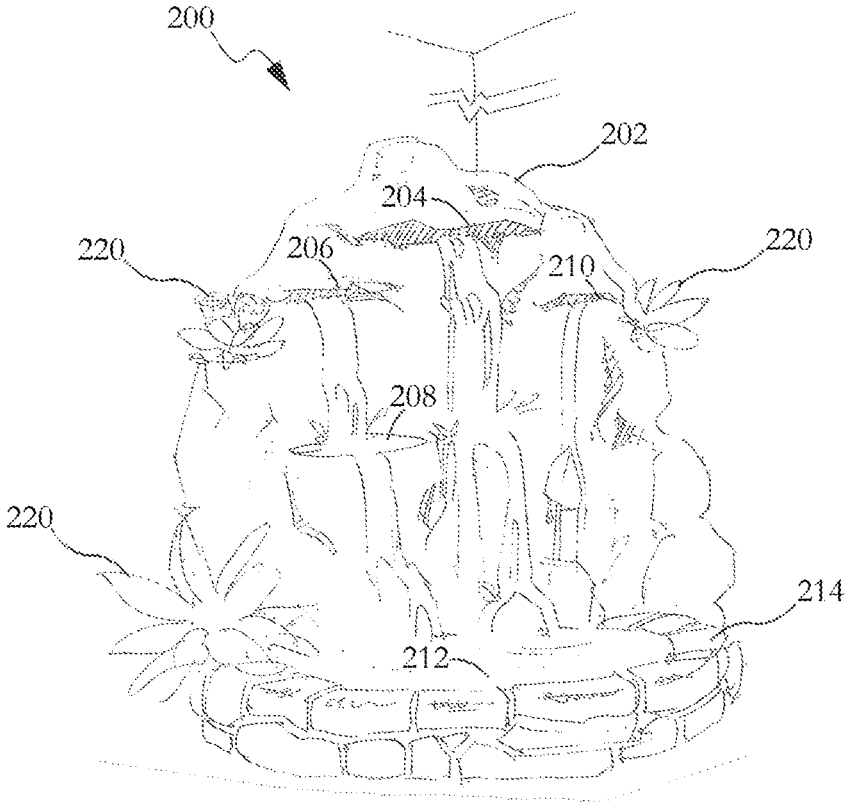
FIG. 2 depicts a perspective view of an indoor waterfall in accordance with an alternative embodiment of the present invention.

Referring now to FIG. 2, a perspective view of an indoor water fixture (200) is shown in accordance with an alternative embodiment of the present invention. The indoor water fixture (200) includes a back wall (202) or structure to serve as a base or housing for support. At an upper portion of the back wall (202) may be an upper reservoir (204) or upper pool. The back wall (202) may comprise a plurality of decorative plants (220), rocks, protrusions, and crevices for a decorative or aesthetically pleasing element on the indoor water fixture (200). The upper reservoir (204) may receive water pumped from behind the back wall (202), and then enable the water to fall into a pool (212). On one side of the upper reservoir (204) may be a second reservoir (206) to collect the water. The water in the second reservoir (206) may flow from the second reservoir (206) and into an intermediate reservoir (208). From the intermediate reservoir, the water falls into the pool (212). Furthermore, a third reservoir (210) may be positioned on an opposite side of the back wall (202) from the second reservoir (206). The water collected in the third reservoir (210) may flow against the back wall (202) and land in the pool (212). The water falling from the first reservoir (204), second reservoir (206) and third reservoirs (210) may cascade over the plurality of decorative rocks, protrusions and crevices for additional splashes creating both visual and auditory enjoyment.

The pool (212) rests within a basin (214). The basin (214) comprises a brick or faux brick wall to encase the pool (212) and is configured at a base of the back wall (202). The back wall (202) may be shaped to rest against a corner of a wall. Behind the back wall is a water pump, as previously described, to circulate the water within the indoor water fixture (200) by continuously recycle the water from the pool (212) to the reservoirs (204, 206 and 210). The alternative embodiment of the indoor water fixture (202) may have a more life-like or realistic appearance, as if a real waterfall, with rocks plants and pools, is breaking out of the wall. The sounds of the water falling within the indoor water fixture (200) may create a soothing sound for a calming effect in a room.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. An indoor water fixture comprising:

a basin to hold a pool of water;

a pair of back walls rising vertically from a back portion of said basin, where said pair of back walls fit against a corner of a room and includes a top shelf to serve as an upper containment wall;

a water pump built within said basin wherein said water pump circulates said water from said basin, behind said pair of back walls;

an upper fall below the top shelf, where the upper fall receives water from the water pump through a first opening above the upper fall;

a first reservoir below the upper fall where the first reservoir collects water from the upper fall and said first reservoir includes a shelf;

a lower fall, where the lower fall receives water overflowing from the first reservoir and said lower fall directs water into the basin, wherein the lower fall, first reservoir and upper fall are aligned an intersection of the pair of back walls;

a second water source on a first wall of the pair of back walls, where the second water source releases water onto a second fall;

a second reservoir, where the second reservoir receives water from the second fall;

a second shelf, where the second shelf is below the second reservoir and receives water overflowing from the second reservoir and the second shelf directs water into the basin;

a third water source on a second wall of the pair of back walls, where the third water source releases water onto a third fall;

a third reservoir, where the third reservoir receives water from the third fall; and a third shelf, where the third shelf is below the third reservoir and receives water overflowing from the third reservoir and the third shelf directs water into the basin, wherein said pair of back walls comprise a pair of splash guards extending along a peripheral edge of said pair of back walls, where said pair of splash guards ensure said water does not escape from either the upper fall, lower fall, second fall or third fall.

2. The indoor water fixture of claim 1, wherein said basin is triangular to fit into said corner of said room.

3. The indoor water fixture of claim 1, wherein said water pump includes a motor to activate said water pump.

4. The indoor water fixture of claim 3, wherein said motor comprises a switch to turn said motor on and off.

5. The indoor water fixture according to claim 1, where said basin includes a plurality of submersible waterproof lights.

* * * * *